US006127940A

United States Patent [19]

Weinberg

[11] Patent Number: 6,127,940

[45] Date of Patent: Oct. 3, 2000

[54] INFRA-RED SECURE REMOTE CONTROLLER

[75] Inventor: Stanley Weinberg, Los Angeles, Calif.

[73] Assignee: Wein Products, Inc., Los Angeles, Calif.

[21] Appl. No.: 09/017,416

[22] Filed: Feb. 2, 1998

[51] Int. Cl.[7] ..... G08C 19/00

[52] U.S. Cl. ..... 340/825.69; 340/825.72; 359/140; 359/142

[58] Field of Search ..... 340/825.69, 825.72; 359/140, 142, 180; 375/327, 329, 332, 370; 313/637, 484

[56] References Cited

U.S. PATENT DOCUMENTS

| | | | |
|---|---|---|---|
| 3,633,067 | 1/1972 | Dubois | 315/149 |
| 4,782,895 | 11/1988 | Weinberg | 340/825.69 |
| 4,789,801 | 12/1988 | Lee | 310/308 |
| 5,015,432 | 5/1991 | Koloc | 376/148 |
| 5,041,760 | 8/1991 | Koloc | 315/111.41 |
| 5,933,090 | 8/1999 | Christenson | 340/825.69 |
| 5,952,936 | 9/1999 | Enomoto | 340/825.69 |

*Primary Examiner*—Michael Horabik
*Assistant Examiner*—Binyam Tadesse
*Attorney, Agent, or Firm*—Price, Gess & Ubell

[57] ABSTRACT

An infra-red secure remote controller having a xenon gas discharge tube which is ignited and pulse modulated with a code impressed on the resultant xenon plasma arc. Each pulse modulated code represents a channel formed of a short pulse burst train of a plurality of high-energy optical pulses. The optical pulses are repeated about 10 to 15 times in a pulse burst train, so that the actual pulse burst train duration will comprise the pulses plus the dark interval time between pulses. Both the pulse length, the dark interval time, and the pulse burst train length are used by circuitry in a receiver for the controller to identify and distinguish an actual transmission from other interfering transmissions. The infra-red remote controller utilizes pulse burst length factors to enhance the reliability of the transmission and increase the possible number of separate codes available.

20 Claims, 7 Drawing Sheets

INFRA-RED SECURE REMOTE CONTROLLER

BACKGROUND OF THE INVENTION

1. Field of the Invention

The present invention concerns the field of signaling devices adapted to use in remote control applications, and in particular relates to an infra-red transmitter and receiver that have outstanding range and immunity to interference.

2. Description of Related Art

Communication links for remote control applications have used a number of different technologies to transmit the remote control signals. At one time, actual physical connections, as through electrical wire, were a common means of implementing remote control. Other direct physical links capable of transmitting data have also been used, including pneumatic lines, hydraulic lines, and optical data fibers. However, most remote control applications operate without a direct physical link between the controller and the device to be controlled. Some type of signal transmission not requiring a physical connection is used instead.

Essentially, signal transmission without physical connection is limited to acoustic or electromagnetic radiation (radiant energy). Acoustic systems generally have poor range and are limited to direct line of sight applications. While sound waves can readily be reflected around comers, most small portable transmitters do not generate sufficiently strong outputs to make such reflection feasible. In the electromagnetic spectrum, signal transmission is a characteristic of the particular frequency. At longer wavelengths (so-called radio waves), the signals can pass through material objects and can have very good range. A significant problem can be interference from the plethora of naturally occurring radio wave sources. However, the present inventor has previously designed an electromagnetic system particularly advantageous to use with radio waves, but can be used with any radiant energy, that overcomes many of the problems inherent with electromagnetic radiation at these frequencies. This system is described in U.S. Pat. No. 4,482,895, which is incorporated herein by reference.

In spite of these advances made with radio wave communication links, a more advantageous method of performing remote control is through the use of digitally encoded optical signals. Generally, these optical signals are generated by light emitting diodes (LED) in a small hand-held remote controller. These transmissions are generally limited to infra-red (IR) wavelengths in order to make them invisible to humans. This produces a small, inexpensive remote control system that is generally immune to any interference or spurious signals. These remote controllers are advantageously employed in any of a large number of consumer electronic devices, such as televisions, VCRs, stereos and even home security systems. This same technology is also widely employed to synchronize separate devices, such as in "slave" photographic flashes. A general limitation of this technology is that it is limited to line of sight applications indoors. While IR can be reflected around comers similar to acoustic energy, small hand-held transmitters are generally incapable of producing sufficiently bright IR beams to take advantage of such reflection. Further, the IR beams are generally too weak to effectively compete with sunlight in outdoor applications.

Therefore, there remains a significant need for a remote control technology with the freedom from interference of the current IR system while providing extended range including outdoor operation. Besides the current uses of IR remote controllers, such an improved technology would also be applicable to certain new uses. In particular, such a technology would be ideal for remote detonation of explosives, as in construction and ordinance demolition. Currently, these remote control functions are carried out with radio wave-based devices, which unsatisfactory pose the significant danger that random interference will cause an inadvertent explosion. While it is possible to apply elaborate encryption technologies to radio wave-based remote detonators, this adds considerable complexity and cost to the receiver which is necessarily a disposable unit that does not survive the explosion that it initiates.

As will be explained below, the present inventor has adopted a solution to the countervailing demands of remote control devices that depends on pulse coded optical energy produced by a gas discharge tube. A properly modulated gas discharge tube, such as a xenon flash tube, can produce an extremely bright output with relatively modest power input. Further, a significant percentage of such radiation is in the infra-red wavelength, so that the pulsed optical signal is essentially invisible with proper filtering. This pulsed optical radiation can be used outdoors to provide line of sight remote control over a distance of many miles if properly columnated. Indoors, the extraordinary intensity of the signal allows it to be efficiently reflected by walls and other surfaces allowing remote control around at least four light blind comers.

OBJECTS AND SUMMARY OF THE INVENTION

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

It is a primary object of the present invention to overcome the aforementioned shortcomings associated with the prior art.

Another object of the present invention is to provide an infra-red remote controller having a secure transmission immune to electrostatic or electromagnetic interference.

Yet another object of the present invention is to provide an infra-red secure remote controller capable of providing remote control activation of devices outdoors over an extended distance.

A further object of the present invention is to provide an infra-red secure remote controller capable having sufficient intensity to allow a control signal to be reflected around at least four light blind comers to activate a remotely controlled device.

It is yet another object of the present invention to provide an infra-red secure remote controller capable of being encoded to transmit over 100,000 different possible channels.

Still another object of the present invention is to provide an infra-red secure remote controller utilizing a transmission duty cycle lower than used by prior systems to provide greater overall energy efficiency by the remote controller.

These as well as additional objects and advantages of the present invention are achieved by providing an infra-red secure remote controller having a xenon gas discharge tube which is ignited and pulse modulated with a code impressed on the resultant xenon plasma arc. Each pulse modulated code represents a channel formed of a short pulse burst train of a plurality of high-energy optical pulses. The optical pulses are repeated about 10 to 15 times in a pulse burst train, so that the actual pulse burst train duration will comprise the pulses plus the dark interval time between pulses. Both the pulse length, the dark interval time, and the pulse burst train length are used by circuitry in a receiver for the controller to identify and distinguish an actual transmission from other interfering transmissions. The infra-red remote controller utilizes pulse burst length factors to enhance the reliability of the transmission and increase the possible number of separate codes available.

DETAILED DESCRIPTION OF THE PREFERRED EMBODIMENTS

Figure 1:
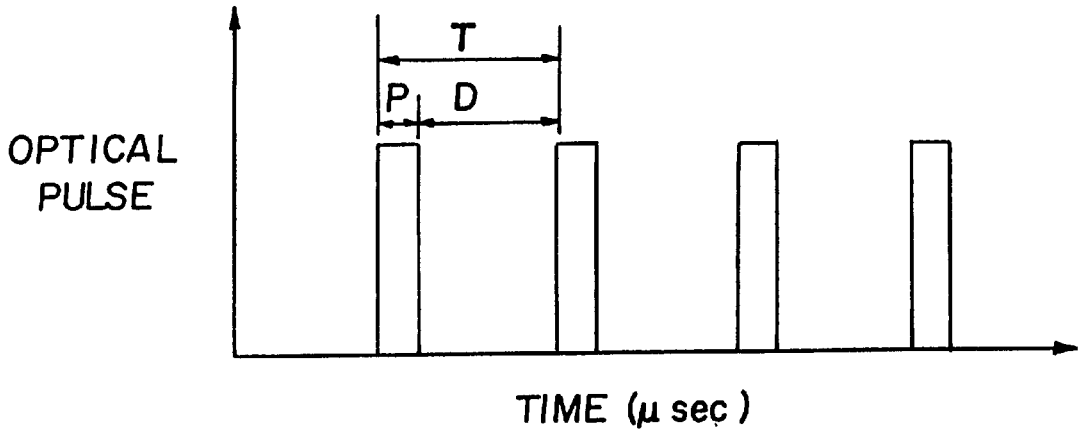
FIG. 1 is a graphical illustration of a pulse burst train for a single tone optical transmission by the remote controller of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a device for pulse code modulating optical radiation from a gas discharge tube and a receiver for detecting the modulated light and determining whether it has the correct pulse code.

Compared to a traditional source of pulse coded optical energy, such as an LED, a gas discharge of a "flash" tube produces an optical output that is many orders of magnitude greater. The present invention uses a xenon discharge tube as an optical source, but the invention is equally applicable to other gas discharge tubes, particularly those containing inert or "noble" gases such as krypton. The key to the extraordinary brightness of these light sources is that they are the product of a very rapid discharge of a large amount of stored electrical energy. For example, in a typical application, a capacitor might store 10 watt-seconds of power. When this energy is discharged through a flash tube, it can produce a 20 $\mu$sec pulse at a current of 200 A. Thus, the peak power of the flash tube can be extremely high producing an optical pulse that can be detected even in the presence of ambient daylight. The bright light signal produced by the xenon flash tube is preferably produced at a substantially infra-red wavelength, so that the light signal is generally invisible to the human eye. However, the light signal may also be transmitted at a near infra-red wavelength with some visible wavelengths that can be detected by the human eye for monitoring purposes. The infra-red and near infra-red wavelengths are produced by selectively filtering the output of the xenon flash tube using colored filters, such as red, green, and blue filters, to produce a signal having the desired wavelength characteristics.

Therefore, the present invention uses very brief optical pulses with extremely high instantaneous power. The overall duty cycle, however, is kept as short as possible so that the overall power consumption is consistent with a small battery operated device. In its simplest form, the modulation and detection strategy depends upon short pulse trains (bursts) of about 0.5 to 3.0 msec in duration of high energy optical pulses of a strictly defined length, say of about 25 to 50 $\mu$sec. The defined optical pulse will be repeated about 10 to 15 times in a pulse train so that the actual pulse train duration will comprise the pulses plus the dark interval time between the pulses. Thus, if the interval time is 25 $\mu$sec and the pulse length is 25 $\mu$sec, a ten pulse burst will have a duration of 0.5 msec. As explained in U.S. Pat. No. 4,482,895, both the pulse length and the interval time (dark period between pulses) are used by the receiving circuitry to identify and distinguish an actual transmission from noise or interfering transmissions. Thus, by varying the pulse length and the interval time, a large number of distinguishable signals can be produced. The present invention also incorporates novel circuitry to include pulse burst length factors to further enhance the reliability of the transmission and increase the possible number of separate codes available.

Pulse modulating LED output is a simple and well known process. It is possible to produce pulse lengths and dark interval times of virtually any duration. Pulse modulating a gas discharge tube is entirely another matter. In a gas discharge tube, non-conductive gas must first be ionized so that it becomes conductive and discharges stored electrical energy. After discharging, the gas rapidly reverts to its non-conductive form. The optical pulses are preferably kept as short as possible so that there is a maximal power dissipation over a very short time. It has been found that the practical limit for pulse brevity is around 5 $\mu$sec. It takes about this amount of time for the gas to become ionized and fully conductive. It should also be apparent to one of ordinary skill in the art that for providing pulse trains that are readily distinguishable, there may be an advantage to maximizing the difference in length between the optical pulses and the dark interval times. Since the optical pulse length is somewhat circumscribed by the above explained minimum length and a maximum length related to the amount of stored energy available, it is generally advantageous to make the dark interval time considerably longer than the optical pulse.

Another more critical problem is that of producing a pulse train where the optical pulses alternate with carefully controlled dark intervals. It is difficult to accurately switch the extremely high currents found in the brief discharge pulses. Further, if the discharge is switched off for too long (i.e., the dark interval is too long), the gas becomes de-ionized, and it is impossible to produce the next optical pulse. Therefore, the present invention requires very careful regulation of both the optical pulses and the intervening dark interval time, or proper selection of anode voltages and currents to improve residual ionization or the system will shut down prematurely before the entire optical code is transmitted.

To better appreciate the problems solved by the present invention, it is useful to briefly review the operation of a typical xenon or other "flash" gas discharge tube. Usually the discharge tube is connected between ground and the positive terminal of a capacitor bank. Some type of voltage converter circuit transforms a low (usually battery) voltage to a relatively high DC voltage to charge the capacitor bank. If the capacitor is charged to a sufficiently high voltage, the gas in the tube would ionize and the electrical energy stored in the capacitor would be rapidly conducted to ground. However, such a high capacitor voltage would also be liable to corona discharge and other problems. Therefore, the flash tube is provided with a "helper" electrode that is connected to a high voltage "spark" coil. When the spark coil produces a brief high voltage pulse, it ionizes the gas in the tube and the capacitor bank discharges through the gas tube.

The present inventor has discovered that the overall voltage at which the discharge tube is operated (i.e., the voltage to which the capacitor bank is charged) has an important influence on this process. For example, if a typical xenon flash tube is operated at 250 VDC, the maximum dark interval time (i.e., time that the discharge is off) is about 50 $\mu$sec before the plasma in the xenon flash tube will de-ionize. If longer dark interval times are attempted, the discharge stops. Assuming that an optimal optical pulse length is about 50 $\mu$sec also, a maximum dark interval time (50 $\mu$sec) produces a 50% duty cycle which is not ideal from a power consumption standpoint. It will be apparent that the lowest possible duty cycle is desirable from a power consumption standpoint. A longer dark interval time will save power and help maximize the difference between the optical pulse and the dark time interval. Significantly, if the xenon flash tube is operated at 800 VDC, the permissible discharge off time increases to at least 200 $\mu$sec. This means that a pulse train with 50 $\mu$sec optical pulses can have only a 20% duty cycle for an overall significant power savings. If shorter optical pulses are used, an even greater power savings results. This also allows the overall train length to be extended which provides more efficient detection and allows the creation of additional channels for encryption, etc.

A channel in the sense of the present invention represents an optical pulse train that can be distinguished from any other optical pulse train by the receiver of the present invention. The simplest system operates as a "single tone" (ST) transmission. In an ST transmission, each pulse train consists of a repetition of optical pulses of a given length separated by dark time intervals of a given length. A large number of channels can be derived by varying either or both the pulse length and the dark interval length. As shown in FIG. 1, it is typical to express a ST transmission as the time period (T) from the leading edge of one optical pulse to the leading edge of the next optical pulse. Maximum power efficiency can be achieved by using a maximum dark interval length (D), e.g., 200 $\mu$sec. At the same time, optical pulse lengths (P) can be minimized (e.g., 5 $\mu$sec) to limit total power consumption and still allow efficient detection using economical electronic components.

Variations in the dark interval length D allow the creation of many distinct channels. Actual remote control messages can be sent by allowing one channel to directly control one function. This control can be a simple on-off function or a pattern of pulses can be used to achieve more complex control. Alternatively, more sophisticated control can be achieved by sending a sequence of channels to determine a given function. An advantage of this approach is that it is much less susceptible to noise or interference.

Figure 2:
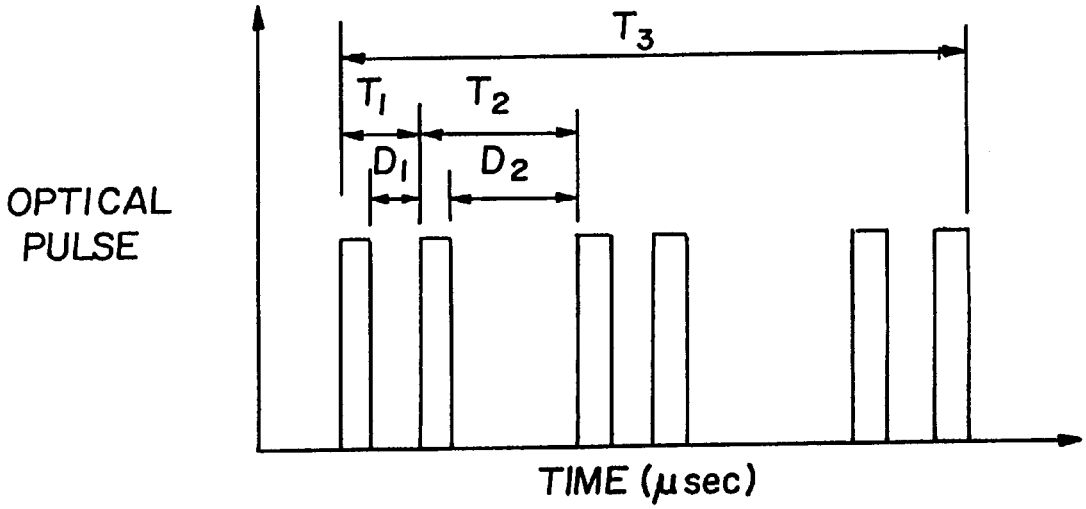
FIG. 2 is a graphical illustration of a pulse burst train for a dual tone optical transmission by the remote controller of the present invention.

In critical applications, such as the detonation of ordinance, a multi-tone (MT) system can be used. In an MT system, a pulse train contains a sequence of different "tones." As explained above, a tone represents the duration between the leading edge of one optical pulse and the leading edge of the next optical pulse in the pulse train. In the simplest case, as illustrated in FIG. 2, the length of the optical pulse is fixed (usually at the minimum length) so that the difference between tone one ($T_1$) and tone two ($T_2$) is caused by a variation in the dark interval time between optical pulses. Table 1 shows an MT system of two tones in which ten channels are created by varying the length of $T_1$, where the length of the second tone $T_2$ and the entire pulse burst length ($T_3$) remain constant. For example, in the case of channel 1, if the optical pulse is 15 $\mu$sec in length, the dark interval time ($D_1$) of $T_1$ is 5 $\mu$sec and the dark interval time ($D_2$) of $T_2$ is 85 $\mu$sec. It will be appreciated that special receiving electronics are necessary to distinguish these channels and that the MT encoding makes the system even more resistant to interference or spurious reception. Additionally, the pulse burst length $T_3$ may be varied to further increase the number of coding possibilities.

TABLE 1

| Channel | $T_1$($\mu$sec) | $T_2$($\mu$sec) | $T_3$(msec) |
|---|---|---|---|
| 1 | 20 | 100 | 1 |
| 2 | 24 | 100 | 1 |
| 3 | 28 | 100 | 1 |
| 4 | 32 | 100 | 1 |
| 5 | 36 | 100 | 1 |
| 6 | 40 | 100 | 1 |
| 7 | 44 | 100 | 1 |
| 8 | 48 | 100 | 1 |
| 9 | 52 | 100 | 1 |
| 10 | 56 | 100 | 1 |

A major problem, then, is to synchronize the encoding process (either ST or MT) with the triggering of the flash tube discharge. Attempting to turn on and modulate the plasma and light output of a xenon flash type tube is extremely difficult as the series chopper element, such as a power FET, must be synchronized properly with a high voltage trigger pulse. Once plasma begins to flow, interrupting the ionized gas stream by switching the series element on and off to impress a digital code will disable the arc and shut the flash tube down, unless certain maintenance conditions are met during the off period. De-ionization can occur if the parameters are not chosen properly. The former technology used in previous designs suffered from short range, erratic operation and a very limited number of available channel options due to de-ionization and flash tube shut down problems. Accordingly, it is important that the maximum dark interval not be exceeded so that the discharge is not prematurely cut off. By operating the xenon flash tube with a high voltage trigger pulse, a large plasma flow is created in the xenon flash tube which is sufficient to support a dual tone pulse train for better encryption as well as supporting longer dark interval times.

Figure 3:
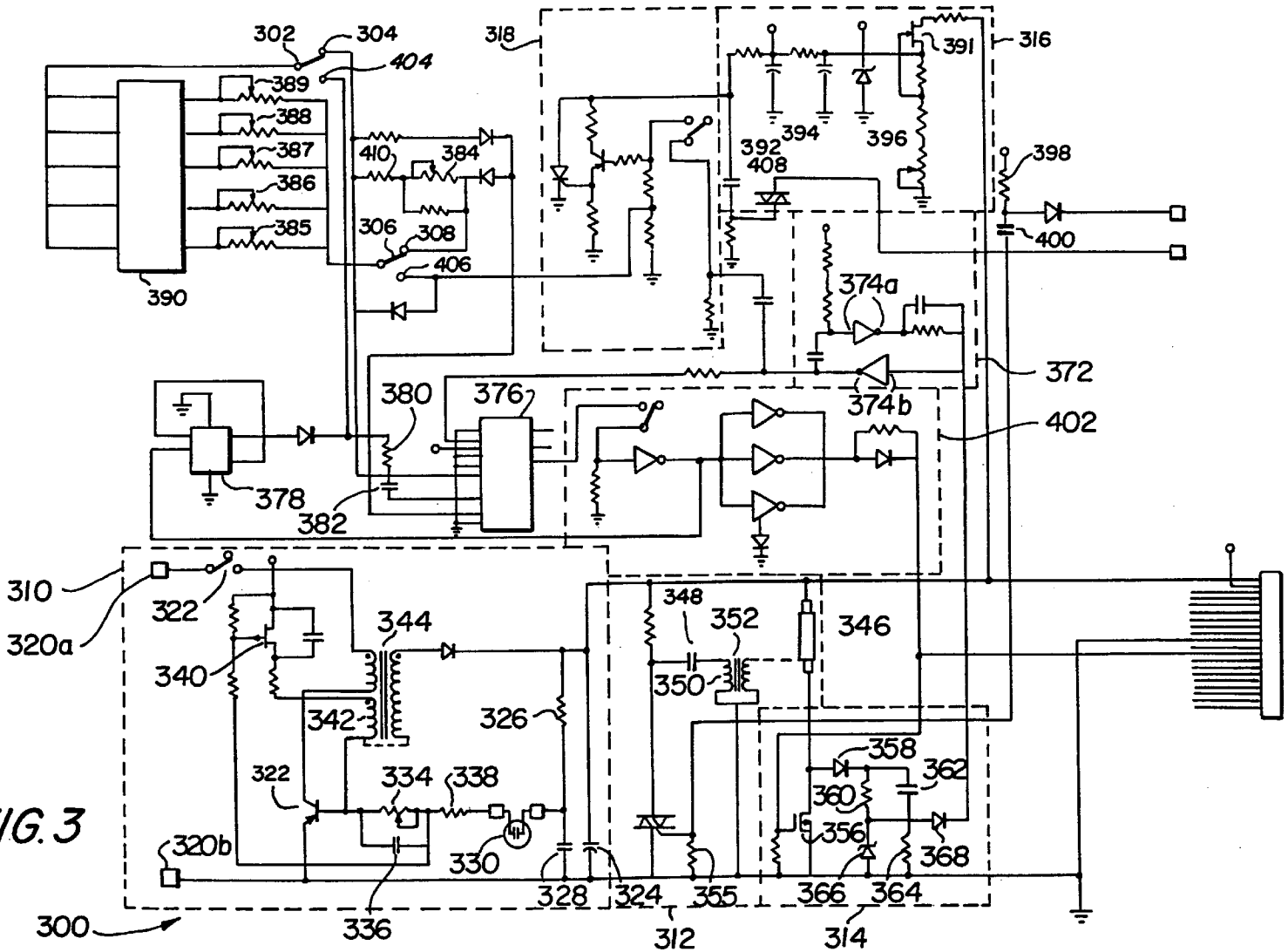
FIG. 3 is a circuit diagram of a preferred embodiment of a transmitter for the remote controller of the present invention.

Referring now to FIG. 3, a preferred circuit for the transmitter for achieving xenon flash tube pulse modulation within the parameters of the present invention is illustrated. This circuit includes a number of advanced features, but the principles of present invention are equally applicable to simpler circuits. For non-critical applications, a ST optical transmission can be implemented by the transmitter 300 of the present invention by switching the connection of switch 302 to lead 304 and the connection of switch 306 to lead 308. An example of a simple non-critical application is "slave" photography remote control. A need exists for professional photographers to remotely control lighting in synchronization with their cameras for creative photographic effects. For instance, professional photographers may have an on-camera or local flash, but also utilize a remote flash for special lighting requirements.

The transmitter 300 includes a converter and high voltage power bank section 310, a high voltage trigger section 312, a sync network section 314, a micro-power logic circuit 316, and a delayed output section 318, as indicated by the dashed lines in FIG. 3. The converter & high voltage power bank section 310 is connected to a voltage source, such as a 3 volt battery, across terminals 320*a* and 320*b*, where switch 322 is closed to apply a voltage across terminal 320*a* and 320*b* in order to turn on the power of the transmitter 300. Upon closure of switch 322, converter section 310 starts charging 300 microfarad capacitor 324 to 300 volts DC. Further, converter section 310 includes a neon bulb relaxation oscillator, comprising a 10 megaohm resistor 326, a 0.015 microfarad capacitor 328, and a neon bulb 330, which supplies turn off pulses to the base of PNP transistor 332. The voltage source charges capacitor 328 with an RC time constant determined by resister 326 and capacitor 328, until the voltage across the neon bulb 330 is sufficient to turn it on. Once lit, neon bulb 330 presents a shunt low resistance path to the capacitor 328, and the voltage across the capacitor 328 falls exponentially until the neon arc is quenched where the bulb is returned to its "off" state and the cycle repeats. This same turn off pulsing also charges the network comprising 2 megaohm potentiometer 334, 0.47 microfarad capacitor 336, and 6.8 kiloohm resistor 338 to supply positive turn-off voltage levels to a P-channel, positive-junction field effect transistor (JFET) regulator 340. This causes regulator 340 to switch off and starve feedback winding 342 of converter transformer 344 by adjusting potentiometer 334 to produce a micro-power voltage regulation circuit which sets a 5% voltage regulation on the charging of capacitor 324. The regulator 340 pulses occasionally to top off the voltage, wherein the current from the voltage source is less than a milliampere, depending on the leakage current of the capacitor 324 supplying transmission power and plasma current to a flash tube 346 of the transmitter 300.

High voltage trigger section 312 initiates an arc in the flash tube 346 using current supplied from capacitor 324. The current from capacitor 324 charges capacitor 348 and flows through a primary coil 350 of a high voltage flash ignition transformer 352 as capacitor 348 discharges. A CK890 triac 354 is connected to capacitor 348, so that when triac 354 fires, the 300 volts stored in capacitor 348 causes a high pulse current in transformer 352. Transformer 352 steps up this voltage through a high turns ratio to about 10 kilovolts, which initiates the arc in the flash tube 346 connected to the secondary coil of transformer 352.

As the arc is struck in the flash tube 346, current can only flow from the power bank capacitor 324 into the sync network section 314, since a code chopper high power field effect transistor (FET) trigger 356 attached to the flash tube 346 is not conducting. Current is forced to flow through a diode 358, a 470 kiloohm resistor 360, a 0.1 microfarad capacitor 362, and finally into a resistor 364. Zener diode 366 causes a synchronization zener controlled pulse of 12 volts to be conducted through diode 368 and 6.8 kiloohm resistor 370 to a CMOS monostable multivibrator 372 (indicated by dashed lines). Monostable multivibrator 372 comprises two gates 374*a* and 374*b* of a hex inverter CMOS 4069. Gates 374*a* and 374*b* are configured to produce a negative going adjustable monostable output from the positive sync pulse produced by sync network section 314. This monostable output is connected to pin 4 of pulse burst oscillator 376 to activate the pulse burst oscillator 376, which may comprise a micro-powered precision monostable multivibrator, such as a 4047 CMOS. The output from pulse burst oscillator 376 then activates the FET trigger 356. This synchronizes the plasma in the flash tube 346 to ignite at exactly the same time as conduction in the FET trigger 356 is enabled in order to enable the coded pulse bursts to be impressed on the flash tube 346 discharge while modulating the discharge properly. If the FET trigger 356 is not properly synchronized with the ignition of the plasma in the flash tube 346, then modulation on the flash tube 346 discharge does not occur and the coded pulse bursts are not impressed on the flash tube 346 discharge.

When active in the dual tone mode, pulse burst oscillator 376 is controlled by a 4013 flip-flop CMOS 378 and by a RC network of 22 megaohm resistor 380 and 180 picofarad capacitor 382, which are connected to pins 1 and 3 of the pulse burst oscillator 376. Pins 1 and 3 are connected through a 100 picofarad capacitor 381. Pin 6 of the pulse burst oscillator 376 is connected to the system voltage $V_{DD}$, which is the positive side 320*b* of the battery. By adjusting the various resistances of various potentiometers 384–389 connected to the pulse burst oscillator 376, various code and encryption schemes can be produced by the transmitter 300. A dip switch 390 or other similar device is connected to the potentiometers 384–390 to control which potentiometers 384–390 will be connected to pulse burst oscillator 376 to determine the coding and encryption scheme of the transmitter 300. All of the logic and triggering circuits are powered by the micro-power logic circuit section 316. The micro-power logic section 316 includes a 33 microfarad capacitor 392, a 220 microfarad capacitor 394, and a 1N5246 zener diode 396 connected to a LND150 N-channel depletion mode FET 391. By applying voltage $V_{DD}$ to FET 391, a constant current is used to set a zener controlled voltage on capacitors 392 and 394, which supplies about 14 volts to all of the logic and triggering circuits.

The 14 volts are supplied across a 4.7 megaohm resistor 398 to charge a 0.047 microfarad capacitor 400 connected between connectors J2 and J3. When J3 is grounded, a negative voltage appears across a 1.2 kiloohm resister 355, thus triggering triac 354 and activating high voltage trigger pulse transformer 352. Inverter network 402 is connected to pin 13 of pulse burst oscillator 376, where inverter network 402 includes a 5 gate 4069 CMOS network to invert the output of pulse burst oscillator 376 and to drive the gate of high power chopper FET 356. The transmitter 300 also includes a delayed output section 318 which fires a delayed output to control an attached device, such as an on camera or local flash, connected to J2 after the remote flash code has been transmitted.

For critical applications, a dual tone optical transmission can be emitted by the transmitter 300 by replacing the dip switch with a key pad and connecting switch 302 to lead 404 and switch 306 to lead 406. Each key button places a new code resistor 384–390 into the RC frequency control loop, and it also fires the entire system when J2 is connected to J3. In this more critical application, a dual tone is used to further encrypt the system. For instance, 4 sequenced keypad activations can be transmitted, which the receiver can process, decode and trip a detonation mechanism for ordinance control detonation. Only after receiving all four valid transmissions in proper sequence and in a required time period would the receiver trip the detonation mechanism.

In order to accomplish synchronization, the transmitter 300 circuitry of the present invention shows a pulse forming network that drives the pulse code burst logic block when activated by the primary J3 trigger for ST operation or when J2 and J3 are connected and the touch pad activates the high voltage initiation trigger of the flash tube for DT operation. Switch 306 conducts the small pre-ionization current produced by the trigger circuit and small anode current to a network comprising 0.047 microfarad capacitor 408, resistor 384, and 39 kiloohm resistor 410. This network reduces the high voltage tube pre-ionization pulse and conditions the wave form. A 16 kiloohm resistor 412 and a CMPD7000 diode 414 are connected across this network to limit the voltage and current supplied to a CMOS logic level to drive the pulse burst oscillator 376 and hence the micro power for a stable oscillator. This synchronized pulse burst drives the gate of FET 391, which then impresses a digital encryption code onto the plasma of the conducting flash tube. The xenon flash tube 346 is capable of producing extremely intense infra-red transmissions of narrow pulse bursts, rather than a single discharge, by keeping a minimum number of active ions available in the tube 346 during the dark interval time. By raising the capacitor bank voltage through high voltage trigger pulse transformer 352, active ionization can be maintained in the tube 346 for time periods exceeding 100 $\mu$sec. The signal produced by the xenon flash tube 346 is preferably produced at either a substantially infra-red wavelength or a near infra-red wavelength having some visible wavelengths, where the output of the xenon flash tube 346 is passed through a series of colored filters (not shown), such as red, green, and blue filters, to selectively filter the output and produce a signal having the desired wavelength characteristics.

The transmitter 300 produces a precise transmission having a securely encrypted code by providing complex multi-code modulation/demodulation schemes of over 100,000 possible channels by simply programming potentiometers. The xenon flash pulse produced is advantageous over prior systems, since the xenon pulse can not be jammed by radio frequencies or electromagnetic pulses. Further, since the logic and triggering circuits of the transmitter 300 are micro-powered, the transmitter 300 can yield thousands of transmissions on just two AA alkaline penlight cells and the transmitter 300 can be left on indefinitely.

Figure 4:
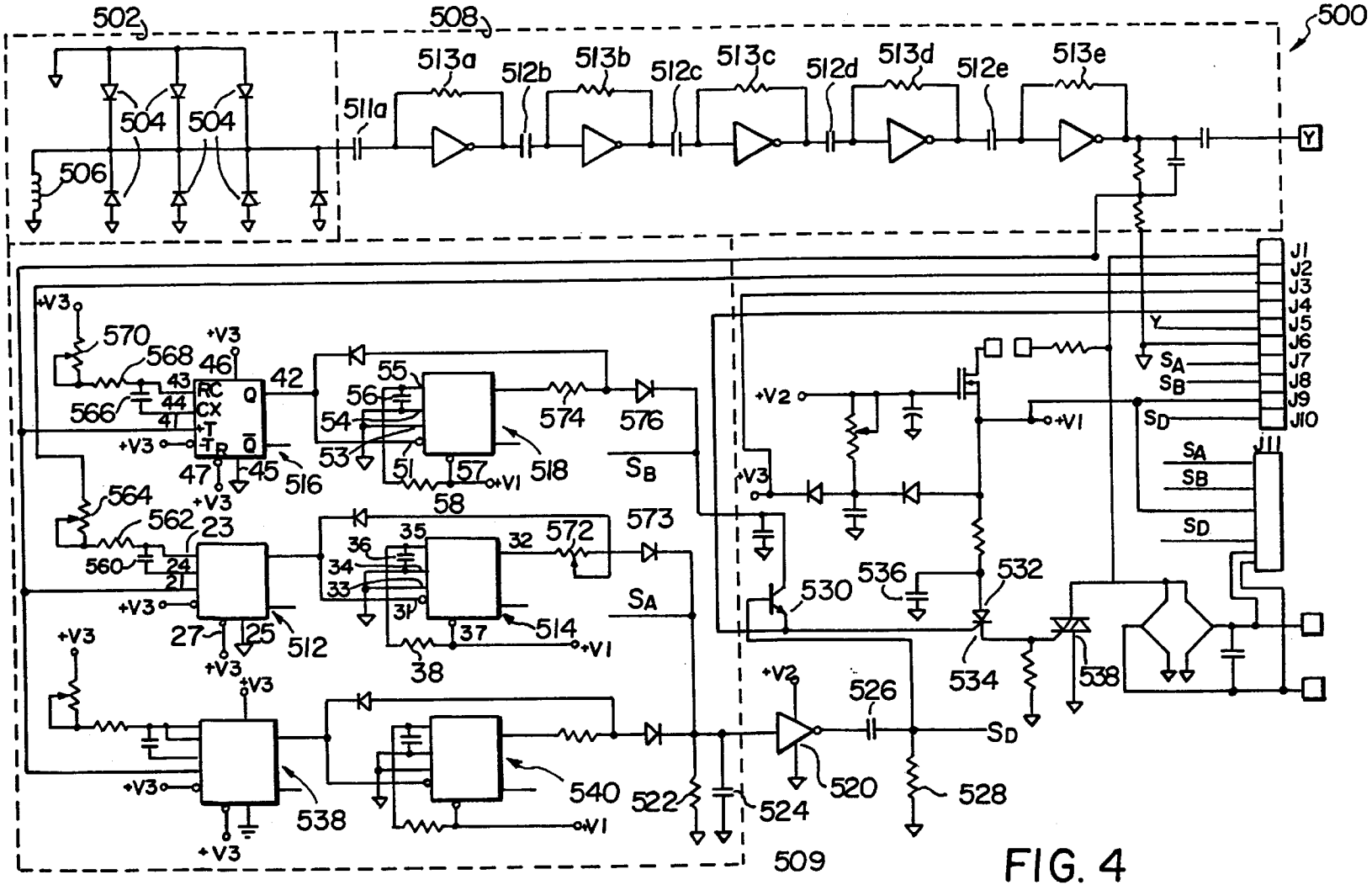
FIG. 4 is a circuit diagram of a preferred embodiment of a receiver for the remote controller of the present invention.

The transmitted pulse train is received, processed, and decoded by a receiver 500 to activate the desired device, such as a camera flash or detonate an ordinance. FIG. 4 shows a preferred circuit for the receiver 500 for demodulating the xenon flash tube pulse burst within the parameters of the present invention. This circuit includes a number of advanced features, but the principles of the present invention are equally applicable to simpler circuits.

The receiver 500 is powered by an on-board battery supply, such as by two CR2025 lithium batteries providing a 6-volt supply, where this battery supply will last about 10 years in actual use because the entire receiver 500 circuitry draws only 3 micro-amperes during both stand-by and activation modes. Previously in photo applications, power supply voltage could only be drawn from the actual sync circuits of various flash units. The new circuit configuration of the present invention allows power to be drawn from an on-board 10 year lithium battery supply.

The receiver 500 circuitry includes a detector section 502 for receiving the pulse coded xenon optical transmission, which includes a concentric array of parallel infrared (IR) detector diodes 504, such as Seimens SFH205 or Litton LTR516AD diodes. The concentric array allows 360 degree signal reception, and the parallel configuration of the diodes 504 increases the S/N ratio. The detector diodes 504 operate photo-voltaically to receive the transmitter optical pulses and convert them to a corresponding output voltage which is applied across a high inductance ambient light cut-out filter 506, such as a 100 millihenry inductor. Ambient light cut-out filter 506 prevents ambient light from passing through the receiver as only rapidly changing pulses are passed through the filter 506. All slowly charging voltage levels are suppressed by the action of the large inductance. The ambient light cut-out filter 506 may also comprise a very high permeability ferrite toroid wound with a large diameter magnet wire. This effectively blocks DC levels due to high ambient conditions from decreasing the dynamic range and therefore the long range distance sensitivity. By designing the inductance properly, 20 to 70 kHz digital signals can be received and processed without ambient degradation. A 200 millihenry inductance is optimum for maximizing the reception of 20 microsecond rectangular pulses without degradation.

Operating in the photo-voltaic mode reduces the energy demands for the receiver 500, as would operation in the photo-conductive mode. This enables the receiver 500 to operate with very low power, but yet very high sensitivity. Also, an automatic gain control (AGC) is realized as a close signal raises the DC threshold and keeps the input amplifier stage from saturation while a far signal lowers the threshold for maximum far distance sensitivity.

A micro-power amplifier section 508 is connected to the output of the detector section 502 for raising the signal level for processing. The amplifier section 508 includes a five-stage array of 4069 CMOS gates 510*a–e* which operate in a low voltage mode below 2.7 volts. This enables the CMOS gates 510*a–e* to run at a micro-powered level of 1.5 microamps. Prior to the present invention, CMOS gates operated at levels above 3 volts, drawing milliamps rather than the microamps drawn by CMOS power amplifier 508. Connected to the inputs of CMOS gates 510*a–d*, respectively, are 56 picofarad capacitors 511*a–d*, where a 470 picofarad capacitor is connected to the input of CMOS gate 510*e*. A 470 kiloohm resistor 513*a* and a 4.7 megaohm resistor 513*b* are respectively connected across CMOS gates 510*a* and 510*b*, while 1.5 megaohm resistors 513*c–e* are respectively connected across CMOS gates 510*c–e*. The five-stage CMOS micro-power amplifier 508 raises the signal voltage level to 3 volts, even for received levels over a transmission distance of some 1,000 feet.

For single tone demodulation, the amplified signal is presented for demodulation to pin 21 of a positive leading edge triggered, retriggerable 4538 CMOS monostable multivibrator 512, whose output on pin 22 is connected to pin 31 of a trailing edge triggered, non-retriggerable 4538 CMOS monostable multivibrator 514. Pins 23 and 24 of monostable multivibrator 512 are connected through a 68 picofarad capacitor 560, while pin 25 is connected to ground. The input to pins 23 and 24 first passes through a 250 kiloohm resistor 562 and a 100 kiloohm potentiometer 564. A supply voltage $V_3$ is provided to mono 512 through pin 26, while $V_3$ is also supplied to pin 27 to power the reset of mono 512. Positive trigger pin 33 and clock pin 34 are each connected to ground, while clock pin 34 is also connected to pin 35 through capacitor 36. Pin 35 is further connected to reset pin 37 through a 150 kiloohm resistor 38.

For dual tone demodulation for critical applications, both tones must be demodulated simultaneously to decode properly. The first tone is presented to monostable multivibrators 512 and 514, while the second tone is presented to pin 41 of a positive leading edge triggered, retriggerable 4538 CMOS monostable multivibrator 516, whose output on pin 42 is connected to pin 51 of a trailing edge triggered, non-retriggerable 4538 CMOS monostable multivibrator 518. Pins 43 and 44 of monostable multivibrator 516 are connected through a 68 picofarad capacitor 566, while pin 45 is connected to ground. Supply voltage $V_3$ is provided to mono 516 through pin 46, while $V_3$ is also supplied to pin 47 to power the reset of mono 516. The input to pins 43 and 44 first passes through a 100 kiloohm resistor 568 and a 100 kiloohm potentiometer 570. Positive trigger pin 53 and clock pin 54 are each connected to ground, while clock pin 54 is also connected to pin 55 through capacitor 56. Pin 55 is further connected to reset pin 57 through a 150 kiloohm resistor 58. When the proper pulse length and pulse width are demodulated by monostable multivibrator 514, a voltage signal will be output on pin 32 and integrated to a DC level through a 20 kiloohm potentiometer 572 and a diode 573 and transmitted to a 4069 CMOS gate 520, a 750 kiloohm resistor 522, and a 470 picofarad capacitor 524, causing a ramp voltage to build on gate 520. Only when monostable multivibrators 512 and 514 are set properly for the received tones will enough ramp voltage cause gate 520 to conduct and fire, as will be described in greater detail hereinafter in the operation of the receiver 500. Thus, monostable multivibrators 512 and 514 provide a sharp filter for demodulating only the precise code it is set to receive. The burst length of the optical transmission must also be long enough to allow the ramp voltage to build sufficiently to fire gate 520.

When enough code is received, the gate 520 goes into saturation and charges output 470 picofarad capacitor 526 to a voltage V2. After a time delay determined by the RC pair of resistor 522 and capacitor 524, the gate 520 comes quickly out of saturation and produces a delay pulse by discharging capacitor 526 through a 150 kiloohm resistor 528. The retriggerable monostable multivibrator and ramp integration trips after completion of full code to enable a number of loads to trigger simultaneously when the ramp voltage reaches the trigger level of CMOS gate 520 firing signal. This delay allows other receivers to "catch up" on code demodulation so essentially they all fire simultaneously. The delay pulse is outputted by discharging capacitor 526 to produce signal $S_D$.

Figure 5:
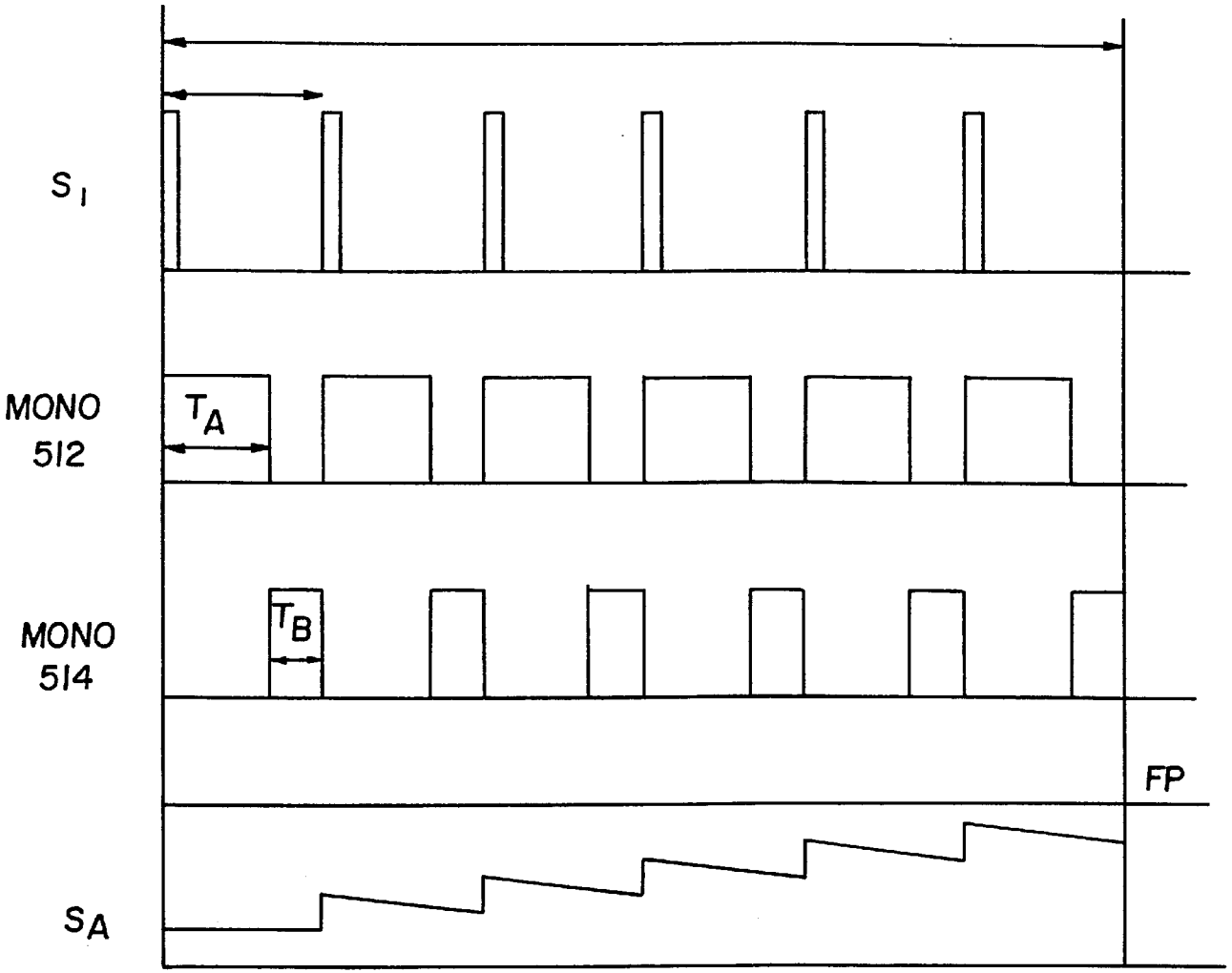
FIG. 5 is a pictorial representation of how the receiver dual monostable multivibrators demodulate the single tone optical transmission shown in FIG. 1.

Referring now to FIG. 5, the operation of the receiver 500 when receiving a single tone optical transmission will be described in greater detail with reference to the signal produced within the circuitry of the receiver 500. The pulse coded xenon optical transmission is received by detection section 502 and output by micro-power amplifier section 508 as pulsed signal $S_1$ having a tone length $T_1$ and channel burst length $T_3$. Pulsed signal $S_1$ triggers monostable multivibrator 512 to output a pulse having a set length $T_A$ upon being triggered. Output pin 22 of monostable multivibrator 512 is connected to the negative input pin 31 of monostable multivibrator 514, so that monostable multivibrator 514 is triggered to fire when $T_A$ times out. Monostable multivibrator 514 outputs a pulse having a set length $T_B$ upon being triggered. If the set length of $T_A$ is greater than $T_1$, then there is no output on pin 22, since monostable multivibrator 512 keeps being retriggered by each pulse of tone $T_1$ before it times out. When $T_A$ is less than $T_1$, then monostable multivibrator 512 times out and fires monostable multivibrator 514. Monostable multivibrator 514 is set in a trailing edge triggered, non-retriggerable mode to make the multivibrator 514 more stable by being less susceptible to interference since it is non-retriggerable. In previous receivers, the second multivibrator of a dual monostable multivibrator system was designed to be retriggerable, which made the multivibrator susceptible to interference. When the set lengths of $T_A$ and $T_B$ are such that they add to equal $T_1$, then the coincidence of the output from the integrator and detector network comprising diode 525, 20 kiloohm potentiometer 527, resistor 522 and capacitor 524 produce a ramp signal $S_A$ that triggers gate 520 into conduction when the ramp signal reach the firing point (FP) of gate 520 in order to activate the receiver 500.

For a dual tone optical transmission, the positive going portion of the delay pulse is fed to 2N5089 NPN transistor 530, where the pulse activates the base of transistor 530. At the same time, monostable multivibrators 516 and 518 are decoding a different pulse length for the dual tone received signal, and the decoded pulse length is integrated to a DC level through a 10 kiloohm resistor 574 and diode 576 and presented to the collector of transistor 530. This forms a pulse coincidence detector at transistor 530 which further adds to the level of encryption of the system. This transistor 530 then drives a gate 532 of a Central CMPS5064 transistor 534 by discharging a 0.047 picofarad capacitor 536 into the gate 532. Transistor 534, in turn, triggers a Central CQ-89D power triac 538 connected thereto to activate the receiver 500.

Figure 6:
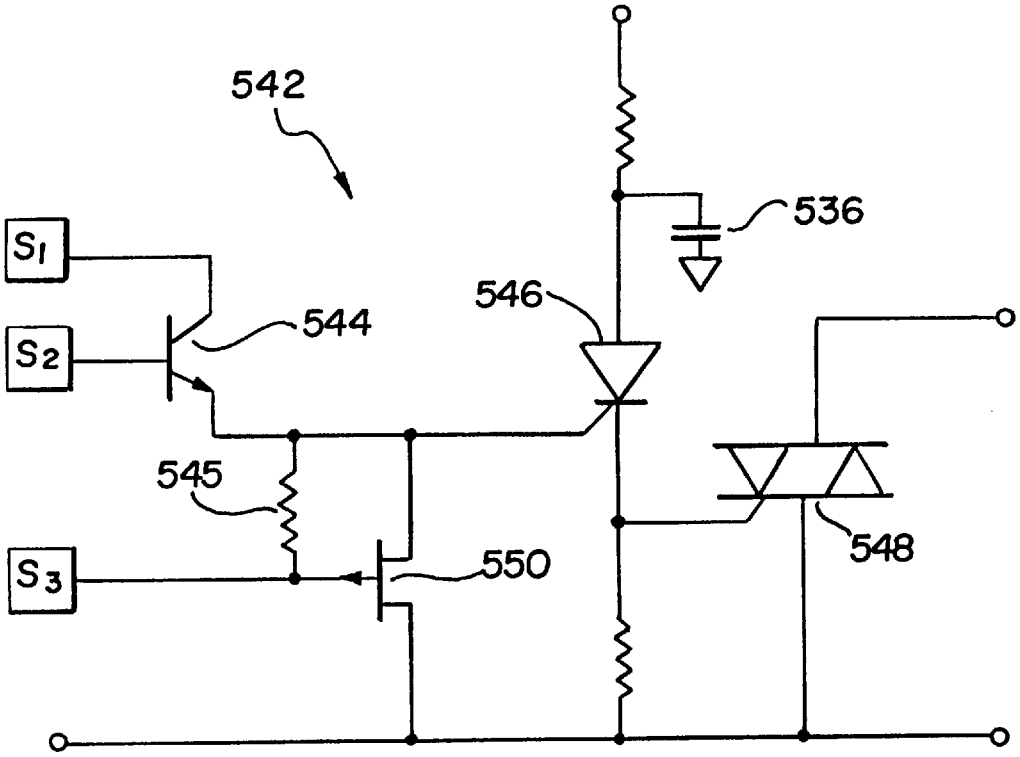
FIG. 6 is a circuit diagram of a preferred embodiment of a pulse coincidence detector in another preferred embodiment of the receiver of the remote controller of the present invention.

An alternate universal channel contained in all receivers that decodes a special signal is also supported by all of the receivers, so that the receivers can be programmed for a different code to operate independently or all receivers can work simultaneous by using this special code contained in decoder 509. This alternate universal channel can also be reconfigured to further enhance code reliability by operating as a positive leading edge triggered, non-retriggerable 4538 CMOS monostable multivibrator 538 driving a negative triggered, non-retriggerable 4538 CMOS monostable multivibrator 540 to detect a proper pulse burst length $T_3$. Mono's 538 and 540 and their attached components function similarly as mono's 516 and 518 and related components. Using this alternative embodiment, three separate security coded factors must coincidentally be presented in order to decode the incoming transmission and fire triac 538. The coincidence detector 542 for this enhanced measure of security is illustrated in FIG. 6. Output signal $S_D$ is transmitted to the base of a 2N5089 NPN transistor 544, while the decoded and integrated pulse $S_2$ output by monostable multivibrators 518 is transmitted to the collector of transistor 544. Monostable multivibrator 540 outputs a decoded pulse $S_3$ through a 22 megaohm resistor 545 to the emitter of transistor 544. When $S_1$, $S_2$, and $S_3$ all produce positive pulses at substantially the same time, transistor 544 fires a silicon-controlled rectifier (SCR) gate 546 connected thereto, which in turn fires power triac 548 to control the desired device attached to the receiver 300. SCR gate 546 and power triac 548 function similarly to SCR gate 534 and triac 538. A J177 positive junction, depletion mode field effect transistor (JFET) 550 is connected across the output of transistor 544. When JFET 550 is not activated by a positive pulse signal received from $S_3$, JFET 550 shorts the SCR gate 546 to prevent it from firing.

Figure 7:
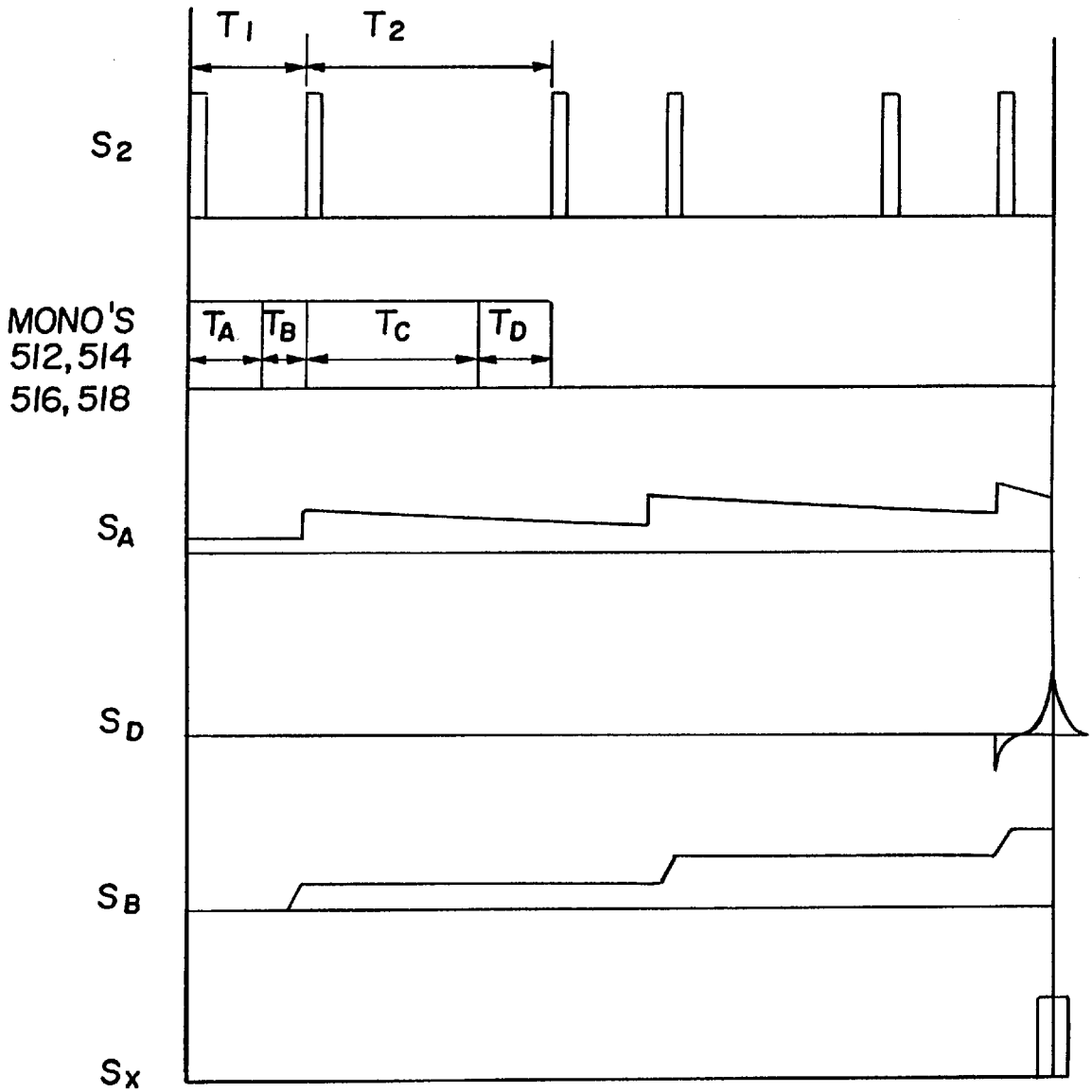
FIG. 7 is a pictorial representation of how the receiver dual monostable multivibrators demodulate the dual tone optical transmission shown in FIG. 2.

Referring now to FIG. 7, the operation of the receiver 500 will be further described for a dual tone optical transmission with reference to the different individual pulses. The pulse coded xenon optical transmission is received by detection section 502 and output by micro-power amplifier section 508 as pulsed signal $S_2$ having a first tone length $T_1$, a second tone length $T_2$, and a pulse burst length $T_3$. $T_1$ triggers monostable multivibrator 512 to output a pulse having a set length $T_A$ upon being triggered, where the trailing edge of $T_A$ triggers monostable multivibrator 514 as described in the operation of a single tone transmission. The coincidence of the output from $T_A$ and $T_B$ with the length of first tone $T_1$ cause ramp signal $S_A$ to build and trigger gate 520 into conduction when the ramp signal reach the firing point (FP) of gate 520 in order to activate the receiver 500. As gate 520 goes into saturation and charges capacitor 526, a delay pulse signal $S_D$ is produced by discharging capacitor 526. The pulse contains an initial negative spike followed by a positive pulse, wherein this delay allows multiple receivers to fire simultaneously without interfering with one another. The positive going portion of $S_D$ is fed to the base of transistor 544.

Meanwhile, monostable multivibrators 516 and 518 are decoding the second tone $T_2$, where $T_2$ triggers monostable multivibrator 516 to output a pulse having a set length $T_C$ upon being triggered, where the trailing edge of $T_C$ triggers monostable multivibrator 518 to produce a pulse having a set length $T_D$, where monostable multivibrators 516 and 518 function similarly as monostable multivibrators 512 and 514. When the combination of the set lengths of $T_C$ and $T_D$ coincide with the length $T_2$ of the second tone, a ramp voltage signal $S_B$ builds on each coincidence of signals, where $S_B$ is fed to the collector of transistor 544. The coincidence of positive pulses from both $S_B$ and $S_D$ on transistor 544 will fire transistor 544.

To further enhance code reliability, a third code factor related to the pulse burst length $T_3$ is employed using monostable multivibrators 538 and 540. Monostable multivibrator 538 is positive leading edge triggered, so that it is triggered by the first tone of optical pulse $S_2$. After a set length of time, multivibrator 538 triggers monostable multivibrator 540, where both monostable multivibrators 538 and 540 are non-retriggerable and operate for a predetermined period of time corresponding the pulse burst length $T_3$ of the channel being detected. After this predetermined period of time, monostable multivibrator 540 produces an output pulse $S_X$. When positive outputs are coincidentally received by the transistor 544 from output pulse $S_X$, $S_B$, and $S_D$, the incoming optical transmission is decoded and the triac 548 is fired.

A sequencing format for $T_1$, $T_2$, and $T_3$ codes can be implemented such that the proper sequence of different $T_1$, $T_2$, and $T_3$ is necessary. This produces thousands of different possible codes, because only when the combination of $T_1$, $T_2$, and $T_3$ codes are transmitted in proper sequence within a predetermined time will the code be validated and the receiver activated.

Figures 8, 9:
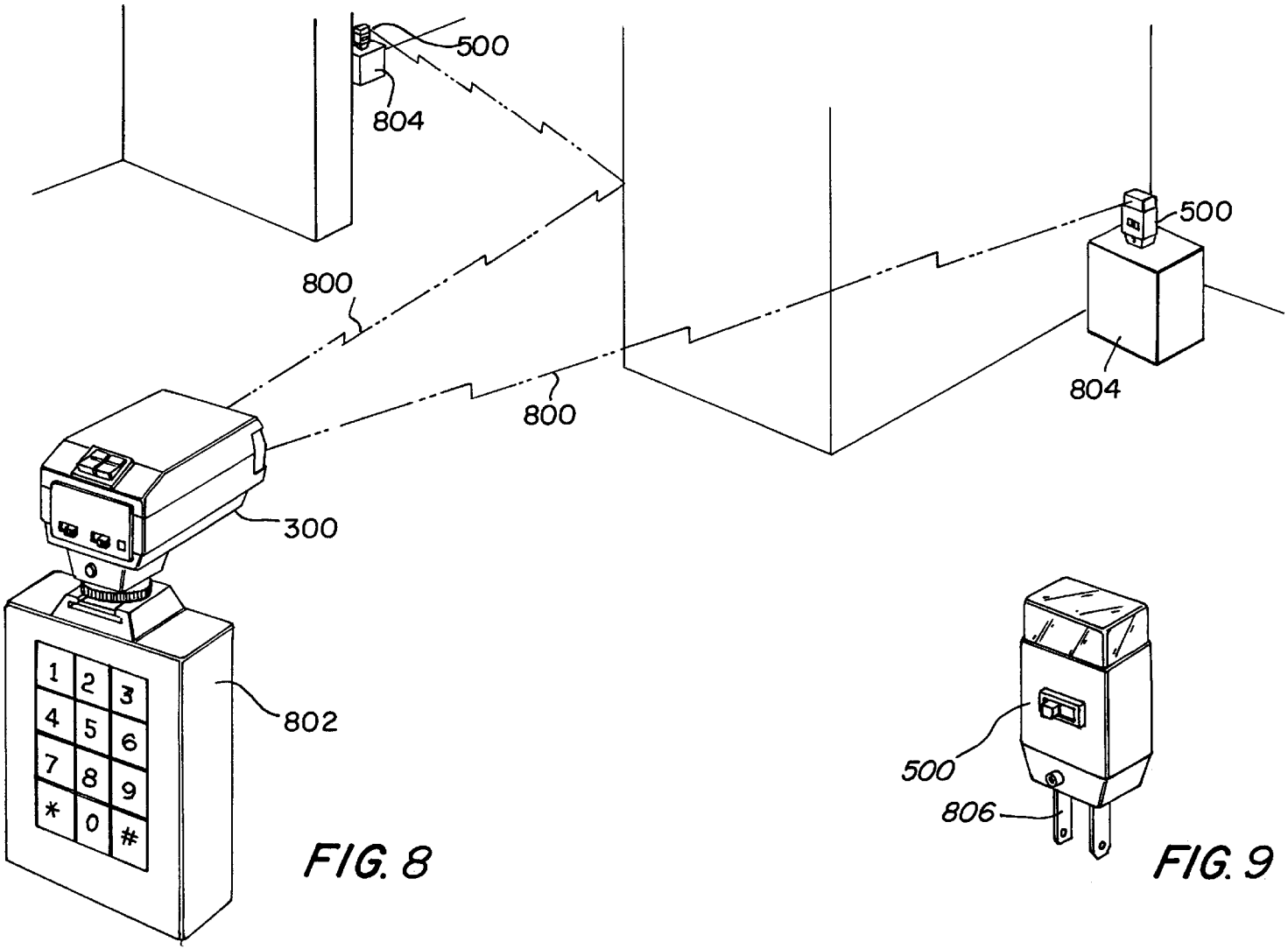
FIG. 8 is a perspective illustration the transmission between a preferred embodiment of the transmitter and receivers of the remote controller of the present invention.
FIG. 9 is a perspective illustration of a preferred embodiment of the receiver of the present invention.

Referring now to FIG. 8, a perspective view of the remote controller system is illustrated with dashed lines 800 indicating the transmission between a transmitter 300 and receivers 500. The transmitter 300 is connected to a controlling device 802, which is illustrated as a key pad activated controller but may comprise any activating device, such as a camera for remote flash photography or a detonator for explosives. The receiver 500 is attached to an activated device 804, such as a flash or an explosive ordinance. The receiver 500 may either be formed integrally with the activated device 804 or may be removably secured to the activated device 804. As shown in FIG. 9, the receiver 500 may be formed having contacts 806 that are plugged into the activated device 804, thus allowing the receiver 500 to be interchangeably connected to various types of activated devices 804.

As can be seen from the foregoing, an infra-red remote controller formed in accordance with the present invention will provide a securely encrypted code of complex multi-code modulation/demodulation schemes of over 100,000 possible channels. Further, the xenon flash pulse produced by the infra-red remote controller of the present invention cannot be jammed by radio frequencies or electromagnetic pulses. Further, since the transmitting and receiving circuits of infra-red remote controller of the present invention are micro-powered, the remote controller can formed in a lightweight, miniature size while having a very low power stand-by current drain for both the transmitter and the receiver of the remote controller.

Those skilled in the art will appreciate the various adaptations and modifications of the just described preferred embodiment can be of configured without departing from the scope and spirit of the invention. Therefore, it is to be understood that within the scope of the appended claims, the invention may be practiced other than as specifically described herein.

What is claimed is:

1. A remote controlling apparatus utilizing infra-red energy comprising:

a transmitter including:

a gas discharge means for emitting an optical signal at a substantially infra-red wavelength or at a near infra-red wavelength with some visible wavelengths for monitoring purposes, a pulse generating circuit for activating the gas discharge means by ionizing a gas in the gas discharge means into a plasma state and modulating the plasma to output a plurality of optical pulses making up an encoded channel, each channel having at least one envelope of a selected pulse width and a selected pulse interval; and a receiver including:

an envelope detection circuit for detecting the transmitted optical encoded channel and outputting a plurality of pulses each having the selected pulse width and selected pulse interval of the transmitted optical encoded channel, coincidence pulse generating means coupled to the output of the envelope detection circuit for determining whether the transmitted optical encoded channel coincides with a stored code, wherein the coincidence pulse generating means further provides an output activating a device attached to the receiver upon a determination of coincidence.

2. The remote controlling apparatus of claim 1, wherein the pulse generating circuit includes a chopper element connected in series with the gas discharge means, the chopper element interrupting the ionized gas stream making up the plasma in order to impress the encoded channel onto the plasma.

3. The remote controlling apparatus of claim 2, wherein the chopper element is controlled to ensure that the ionized gas stream interruption does not disable the arc created in the gas discharge means and allow the gas to de-ionize out of the plasma state during encoding of the channel.

4. The remote controlling apparatus of claim 1, wherein each channel includes a first envelope having a selected pulse width and a selected pulse interval and a second envelope having a selected pulse width and a selected pulse interval;

wherein each channel includes a first tone represented by the length of the pulse width and pulse interval of the first envelope and a second tone represented by the length of the pulse width and pulse interval of the second envelope; the first and second tones repeating adjacent to each other throughout the encoded channel;

each encoded channel comprising a pulse burst length of a selected number of first and second tones.

5. The remote controlling apparatus of claim 4, wherein each channel has a duty cycle equal to the percentage of the pulse burst length encompassed by the combined length of time of all of the pulse widths of the first and second tones, wherein the duty cycle is minimized to optimize the energy efficiency of the transmitter.

6. The remote controlling apparatus of claim 5, wherein the duty cycle is minimized by operating the gas discharge means at a selected voltage level high enough to maintain active ionization of the plasma during the pulsed intervals between the pulses.

7. The remote controlling apparatus of claim 6, wherein the gas discharge means maintains active ionization of the plasma during pulsed intervals of at least 100 $\mu$sec.

8. The remote controlling apparatus of claim 1, wherein the gas discharge means includes a xenon flash tube.

9. The remote controlling apparatus of claim 3, wherein the series chopper element is controlled by pulsed signals received from a pulse burst oscillator;

the pulses produced by the pulse burst oscillator being determined by an input received from a flip-flop CMOS device and a plurality of variably-controlled resistances, wherein the input received by the pulse burst oscillator controls the coding and encryption scheme of the transmitter.

10. The remote controlling apparatus of claim 9, further including a selecting means for selecting which of the plurality of variably-controlled resistances are connected to the pulse burst oscillator to select the particular code to be transmitted by the transmitter.

11. The remote controlling apparatus of claim 10, wherein the selecting means is a remote controller keypad.

12. The remote controlling apparatus of claim 4, wherein the coincidence pulse generating means includes:

a first pair of coupled first and second monostable multivibrators, wherein the first is triggered by each occurrence of a pulse of the first tone, the output of the first connected to the trigger of the second, with the time constant of the first and second related to the length of the first tone, such that a voltage signal is output upon each coincidence of the time constant of the first and second equaling the length of the first tone;

a second pair of coupled first and second monostable multivibrators, wherein the first is triggered by each occurrence of a pulse of the second tone, the output of the first connected to the trigger of the second, with the time constant of the first and second related to the length of the second tone, such that a voltage signal is output upon each coincidence of the time constant of the first and second equaling the length of the second tone;

wherein the device attached to the receiver is activated upon receipt of a selected number of first and second tones sufficient to decode and identify the encoded channel.

13. The remote controlling apparatus of claim 12, wherein the device attached to the receiver is activated only upon the coincidence of receiving a selected number of output voltages from both pairs of monostable multivibrators.

14. The remote controlling apparatus of claim 13, wherein the output voltages from both pairs of monostable multivibrators produce respective ramping voltage signals which are stored in capacitors respectively connected to the outputs of the first and second pairs of monostable multivibrators, the ramping voltage signals building upon each output voltage signal generated by the pairs of monostable multivibrators; the receiver further comprising:

a CMOS gate being connected to the output of the first pair of monostable multivibrators, the CMOS gate conducting and firing only after the ramping voltage signal from the first pair of monostable multivibrators reaches a predetermined level;

the outputs of the CMOS gate and the ramping voltage signal from the second pair of monostable multivibrators being connected to a coincidence detection means for detecting a coincidence of positive pulses from both inputs.

15. The remote controlling apparatus of claim 14, wherein the coincidence detection means comprises a transistor which only conducts and fires upon receipt of coincident positive pulses, the output of the transistor then activating a silicon controlled rectifier which fires a power triac connected thereto to activate the device attached to the receiver.

16. The remote controlling apparatus of claim 15, wherein the coincidence pulse generating means further includes:

a third pair of coupled first and second monostable multivibrators, wherein the first is triggered by the first occurrence of a pulse of the first tone, the output of the first connected to the trigger of the second, with the time constant of the first and second related to the length of the pulse burst length of the encoded channel, such that a voltage signal is output upon a coincidence of the time constant of the first and second equaling the pulse burst length;

wherein the coincidence detection means further includes a pulse burst length detection means connected to the output of the third pair of monostable multivibrators as well as being connected to the output of the transistor, such that the pulse burst length detection means prevents the silicon controlled rectifier from being activated unless a positive output pulse is received from the third pair of monostable multivibrators coincidentally with the firing of the transistor.

17. The remote controlling apparatus of claim 16, wherein the pulse burst length detection means comprises a positive junction field effect transistor which shorts the silicon controlled rectifier gate to prevent firing of the gate until a positive output pulse is received from the third pair of monostable multivibrators.

18. The remote controlling apparatus of claim 2, further comprising plasma trigger synchronization means for igniting the plasma and enabling conduction of the series chopper element at exactly the same time to enable the encoded channel of pulse bursts to be impressed on the gas discharge means and to properly modulate the encoded channel.

19. The remote controlling apparatus of claim 1, wherein the gas discharge means includes a xenon flash unit with red, green, and blue filters allowing selective filtering of the xenon flash unit to produce the infra-red and near infra-red wavelengths.

20. A transmitter for a remote controlling apparatus utilizing infra-red energy comprising:

a gas discharge means for emitting an optical signal at a substantially infra-red wavelength or at a near infra-red wavelength with some visible wavelengths for monitoring purposes;

a pulse generating circuit for activating the gas discharge means by ionizing a gas in the gas discharge means into a plasma state and modulating the plasma to output a plurality of optical pulses making up an encoded channel, each channel having at least one envelope of a selected pulse width and a selected pulse interval;

wherein the pulse generating circuit includes a chopper element connected in series with the gas discharge means, the chopper element interrupting the ionized gas stream making up the plasma in order to impress the encoded channel onto the plasma; and plasma trigger synchronization means for igniting the plasma and enabling conduction of the series chopper element at exactly the same time to enable the encoded channel of pulse bursts to be impressed on the gas discharge means and to properly modulate the encoded channel.

* * * * *